US008448823B2

(12) United States Patent
Engels et al.

(10) Patent No.: US 8,448,823 B2
(45) Date of Patent: May 28, 2013

(54) APPARATUS FOR DISPENSING A PLURALITY OF FLUIDS WITH REMOVABLE ACTUATOR MODULE

(75) Inventors: Marcel Hendrikus Petrus Engels, AX Voorhout (NL); Martin Kruit, MR Voorhout (NL); Nico Van Beelen, VC Katwijk (NL); Ronald Peter Krom, HC Katwijk (NL); Marcus Johannes Voskuil, GT Oegstgeest (NL); Mattijs Oostendorp, DM Delft (NL)

(73) Assignee: Fast & Fluid Management B.V., Sassenheim (NL)

( * ) Notice: Subject to any disclaimer, the term of this patent is extended or adjusted under 35 U.S.C. 154(b) by 245 days.

(21) Appl. No.: 12/986,307

(22) Filed: Jan. 7, 2011

(65) Prior Publication Data

US 2012/0175383 A1 Jul. 12, 2012

(51) Int. Cl.
*B67D 7/78* (2010.01)

(52) U.S. Cl.
USPC ..... 222/144; 222/23; 222/63; 222/132; 222/135; 222/144.5; 222/185.1; 222/233

(58) Field of Classification Search
USPC ..... 222/23, 63, 132, 135, 144, 144.5, 222/185.1, 233
See application file for complete search history.

(56) References Cited

U.S. PATENT DOCUMENTS

| | | | | |
|---|---|---|---|---|
| 2,787,402 | A * | 4/1957 | Stiner et al. | 222/23 |
| 4,096,972 | A * | 6/1978 | Bartels et al. | 222/135 |
| 5,474,211 | A * | 12/1995 | Hellenberg | 222/1 |
| 5,711,458 | A * | 1/1998 | Langeveld et al. | 222/144 |
| 6,935,386 | B2 * | 8/2005 | Miller et al. | 141/18 |
| 7,347,344 | B2 * | 3/2008 | Engels et al. | 222/144 |
| 7,360,564 | B2 * | 4/2008 | Engels et al. | 141/83 |
| 7,527,078 | B2 * | 5/2009 | Driessen et al. | 141/9 |
| 2005/0087545 | A1 * | 4/2005 | Engels et al. | 222/1 |
| 2005/0269367 | A1 * | 12/2005 | Post | 222/185.1 |
| 2006/0261090 | A1 * | 11/2006 | Mink et al. | 222/144 |
| 2007/0012378 | A1 * | 1/2007 | Miller et al. | 141/104 |
| 2007/0044863 | A1 * | 3/2007 | Engels et al. | 141/83 |
| 2007/0084520 | A1 * | 4/2007 | Driessen et al. | 141/2 |
| 2011/0122196 | A1 * | 5/2011 | Hill | 347/47 |
| 2011/0290823 | A1 * | 12/2011 | Miller | 222/132 |
| 2012/0175385 | A1 * | 7/2012 | Voskuil | 222/144 |

* cited by examiner

*Primary Examiner* — Kevin P Shaver
*Assistant Examiner* — Patrick M Buechner
(74) *Attorney, Agent, or Firm* — Miller, Matthias & Hull LLP

(57) ABSTRACT

An apparatus for dispensing a plurality of fluids, includes a support, such as a turntable or a linear table, a plurality of containers for holding a fluid and mounted on the support, pumps and valves connected to respective containers, at least one common actuator for sequentially operating the pumps and valves to dispense fluid and a drive mechanism for moving the support, and thus the containers, pumps, and valves on the one hand and the actuator on the other relative to each other. The common actuator for sequentially operating the pumps and valves and the drive mechanism for relative motion of the support are integrated in a module, the module is releasably mounted in the apparatus.

15 Claims, 3 Drawing Sheets

APPARATUS FOR DISPENSING A PLURALITY OF FLUIDS WITH REMOVABLE ACTUATOR MODULE

BACKGROUND

1. Technical Field

This disclosure relates to an apparatus for dispensing a plurality of fluids, comprising a support, such as a turntable or a linear table, a plurality of containers for holding a fluid and mounted on the support, pumps and valves connected to respective containers, at least one common actuator for sequentially operating the pumps and valves to dispense fluid, thus defining a dispense position, and a drive mechanism for moving the support, and thus the containers, pumps, and valves on the one hand and the actuator on the other relative to each other.

2. Background of the Related Art

EP 800 858 relates to a dispensing apparatus (indicated by 10 in the Figures of EP 800 858) which includes canisters (72) mounted on a turntable (74), the canisters (72) including dispense pumps (130) and valves (136). Actuators for operating the dispense pumps (130) and valves (136) are located on a service door (16) mounted alongside the turntable (74).

US 2006/0169718 relates to a dispenser apparatus including a centrally located vertically mounted column assembly. A plurality of canisters is cantilever mounted to the column assembly. Each canister has a receptacle for holding a fluid and each receptacle includes a corresponding pump for dispensing fluid held therein. The dispenser apparatus also includes a stationary dispensing station having a mechanism for selectively actuating the pump for dispensing fluid held in the receptacle. A mechanism is also provided for engaging a portion of a canister to align a pump corresponding to a receptacle to the stationary dispensing station, wherein the fluid held in the receptacle may be dispensed.

Similar apparatuses are known from WO 2010/113008, WO 2005/107933, WO 2005/039747, EP 1 134 186, and EP 1 090 679.

WO 00/13918 relates to a carousel-type paint toning machine comprising a frame (1); a carousel base (3) arranged rotatably in an upper part (2) of the frame; containers (4) for toning paste, arranged in a circle on the carousel base; means (5) for rotating the carousel base (3); means for mixing the paste in the paste containers, the means comprising a mixer (6) inside each paste container and a gearwheel (7) connected to the mixer and situated below each container; and means (8) for rotating the gearwheels (7) connected to the mixers. In order to reduce the costs of manufacturing the machine, the carousel base (3) and the means (8) for rotating the gearwheels (7) connected to the mixers (6) are formed by cutting them from a single plate.

WO 2005/082510 relates to automatic and manual colorant and hair dye dispensers. The embodiment shown in FIG. 96 shows a stirring arrangement comprising canister-receptacle gears (240, 247) mounted to the bottom of a given stirring rod (221) that projects downwardly from a respective canister. A stirring station or device (242) has a drive gear (244) rotatably mounted on a lever arm (245). The lever arm (245) may be rotated, for example, by means of a bidirectional rotary disc (248) having a guide pin (249) that rides in a guide slot (250) at the free end (251) of the lever arm (245).

EP 2 198 950 relates to an apparatus for dispensing a plurality of fluids, comprising a support, such as a turntable (2) or a linear table, a plurality of containers (4) for holding a fluid mounted on the support (2), pumps (3) connected to respective containers (4), a common actuator (31) for sequentially operating the pumps (3), stirring elements mounted rotatably inside and extending from the containers (4), and a drive mechanism (21) for rotating the stirring elements, wherein the support (2) on the one hand and the actuator (31) and drive mechanism (21) on the other are movable relative to each other. The drive mechanism (21) comprises a protrusion (26) movable between at least a first, extended position (FIG. 2B) for engaging a stirring element (20) and a second, retracted position (FIG. 2A).

Similar apparatuses are known from WO 2010/113008 and EP 813 901.

This disclosure provides an apparatus for dispensing a plurality of fluids that allows more straightforward assembly and/or maintenance.

SUMMARY OF THE DISCLOSURE

To this end, the common actuator for sequentially operating the pumps and valves and the drive mechanism for relative motion of the support are integrated in a module, the module is releasably mounted in the apparatus.

Thus, the module can be manufactured separately and if during use, e.g. at a point of sale, the apparatus malfunctions, the user or a mechanic can quickly and in a straightforward manner replace (swap) the module with a working module to render the apparatus operational again.

In one aspect, the module is positioned beneath the support and/or behind the pumps, i.e. on the side of the containers remote from the actual point of dispensing, and, in case the apparatus comprises a turntable, inside the (outer) ring of the pumps. In a further aspect, the pumps are piston-pumps and extend substantially radially and preferably substantially horizontally.

Thus, the module does not interfere with other components, in particular the turntable and components mounted on the turntable, and/or the point of dispensing can be positioned more towards the front of the apparatus.

In a further aspect, the module comprises a battery and/or an electrical connector for connecting the module to an external power source and/or a connector or receiver for connecting the module to an external controller.

This disclosure also relates to an apparatus as defined in the preamble of this specification, comprising a rechargeable battery and an internal controller for operating the actuators to dispense one or more fluids, wherein the apparatus further comprises an external controller, such as a laptop of desktop computer, and a database for preparing and transmitting instructions, e.g. for dispensing a recipe or formula comprising one or more, e.g. two to five different fluids, such as colorants, to the controller inside the apparatus, and wherein at least one of the controllers is arranged to assess the power required to carry out the instruction(s) and assess the power available in the battery. In an aspect, dispensing of fluid is prevented and/or a signal, e.g. a message or beep, is generated if the power available in the battery is insufficient, i.e. lower than the power required to carry out the instruction(s). In a further aspect, a signal, e.g. a message or beeps, is generated which indicates how many recipes or formulas can still be dispensed.

In these configurations, which can also be applied in embodiments not having the swappable module specified above, faulty dispensing, such as so-called miss-tints when dispensing colorants, e.g. in case of continued use of the apparatus by a shop owner relying on a UPS during an outage, can be avoided. Also, when this configuration is used in combination with an external controller that comprises a battery, e.g. a laptop, a (n expensive) UPS is in principle not required, at least not for preventing miss-tints.

To prevent faulty dispensing resulting from an interruption in data transfer from the external controller to the controller inside the apparatus, in a further aspect, the external controller is arranged to combine the instructions for dispensing two or more fluids, e.g. forming a recipe or formula, into a single set and transmit the set to the internal controller. In other words, instead of step by step transfer of instructions, a complete dispense job is transferred in a single instruction set enabling the dispenser to complete the job, even if communication with the external controller is temporarily lost.

This disclosure further relates to an apparatus as defined in the preamble, comprising stirring elements mounted rotatably inside the containers and partly extending from the containers and a drive mechanism for rotating the stirring elements. In an aspect, the parts of the stirring elements extending from the containers are provided with gears and the drive mechanism comprises a motor, an arm, and a driving gear mounted on the arm such that the driving gear is movable in and out of engagement with the gear on the stirring element of the container at the dispensing position.

In a further aspect, the drive mechanism comprises a further gear mounted on the drive shaft of the motor and coupled, by direct engagement or indirect engagement e.g. via one or more further gears or a belt or chain, to the driving gear.

In another aspect, in the engaged position, the arm and the (imaginary) line connecting the axis of rotation of the gear on the stirring element and the axis of rotation of the gear are at an angle in a range from 80° to 120°, preferably in arrange from 85° to 100°. Such angles provide a good balance between reinforcing engagement and actual transmission.

These configurations, which can also be applied in embodiments not having the swappable module or power and data arrangements specified above, require a limited number of parts and a single motor for both moving the driving gear in and out of engagement and driving the stirring elements. Yet, the risk of misalignment of the driving element and the driven stirring element is reduced or even avoided.

In an aspect of this disclosure aimed at reducing volume during transport, the apparatus comprises a hollow, e.g. substantially tubular or bucket-shaped, base for carrying the support, e.g. a turntable, during use. When the apparatus is disassembled, at least the containers, pumps, and valves can be stored inside the base, e.g. using the turntable as a lid.

In a further aspect, the base holding components of the disassembled apparatus is packaged in a box made of e.g. cardboard. Such a package in principle can be stored and transported without a pallet.

Assembly is facilitated if each of the containers forms, together with a valve and pump, a module that can be secured to the support, e.g. by snap fitting or a single attachment means, such as a screw or clip.

Within the framework of this disclosure, the term "fluid" is defined as any flowable material that can be dispensed by the apparatus according to this disclosure. Examples of fluids include liquids, pastes, granulates, and powders. The term "stirring element" includes stirring elements comprising two or more components, e.g. comprising a transmission.

The drawings are not necessarily to scale and details, which are not necessary for understanding this disclosure, may have been omitted.

DETAILED DESCRIPTION OF THE PRESENTLY PREFERRED EMBODIMENTS

Figure 1:
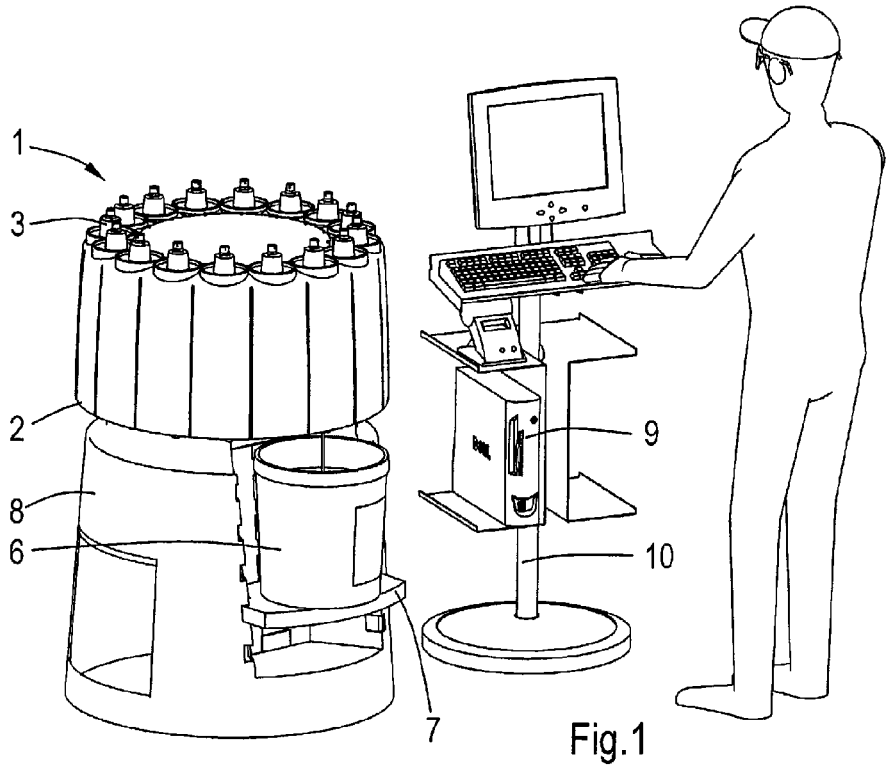
FIG. 1 is a perspective view of an apparatus for dispensing fluids according to this disclosure in conjunction with an external computer system.

FIG. 1 shows an example of an apparatus 1 for dispensing a plurality of fluids, such as (components of) paints, paint colorants, hair dyes, shampoos, foundations, and the like. It can be used for dispensing numerous recipes and formulas of the said products and it can be located e.g. at a retailer of decorative paints, a hairdresser, or a spa, respectively.

Figure 2:
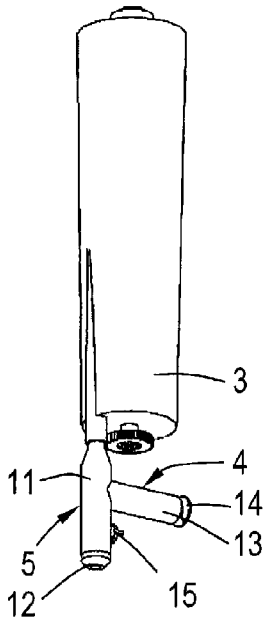
FIG. 2 is a perspective view of a module comprising a container, a pump, and a valve.
Figure 8:
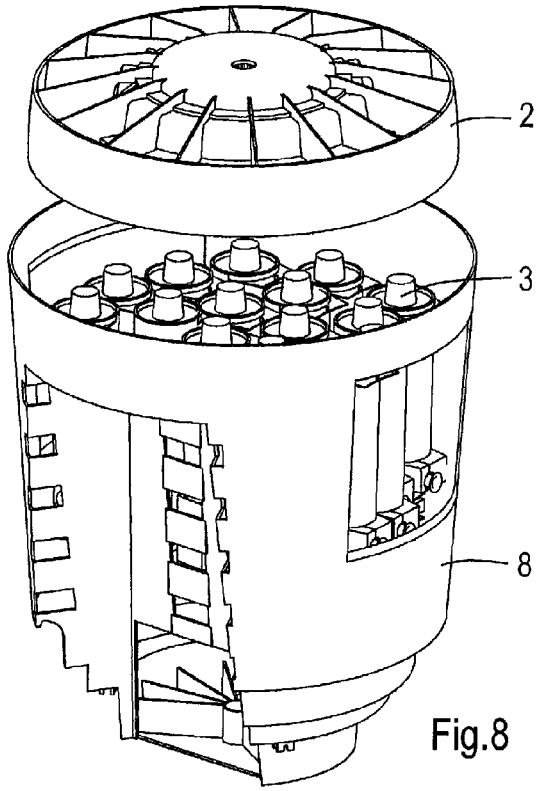
FIG. 8 shows the apparatus according to this disclosure while it is being prepared for transport.

This particular dispensing apparatus 1 is an automated version and includes a horizontal turntable 2, with a plurality of containers 3 mounted along its circumference. Each container 3 is provided with a pump 4 and a dispense valve 5 (FIG. 2). The turntable 2 can be rotated between discrete positions, e.g. twelve or sixteen positions including a dispensing position, i.e. a position where the pumps and valves are operated by means of a central actuator, as will be explained in more detail below. Fluids are dispensed in a receptacle, in this example a bucket 6 on an adjustable shelf 7.

The apparatus 1 includes a base 8 made e.g. by injection moulding a polymer. A computer 9 for entering and storing information, such as customer data and recipes, and generating instructions for driving the turntable 2, pumps and valves, is positioned on a separate stand 10.

Further information regarding suitable turntables and procedures for driving the various components, are disclosed in, for instance, European patent applications EP 800 858, EP 1 492 970, EP 1 688 652, and EP 2 198 950.

As shown in FIG. 2, each valve 5 comprises a housing 11 fitted in or near the bottom of a container 3. The housing 11 comprises an outlet opening 12 in or near its bottom. The pump 4 is integrated in the valve 5 and comprises a cylinder 13 and a piston and piston rod slidably accommodated inside the cylinder 13. The piston rod is provided, on its proximal end, with a washer or flange 14. Further, the valve 5 comprises an operating element, e.g. a handle, lever, or, in this example, a rotary knob 15.

The valve 5 and rotary knob 15 provide three positions, a first or closed position wherein both the outlet opening and the connection between the container and the pump are closed, a second or intake position wherein the connection between the container and the pump is open and the outlet is closed, and a third or dispense position wherein the connection between the container and the pump is closed and the outlet is open.

Figure 3:
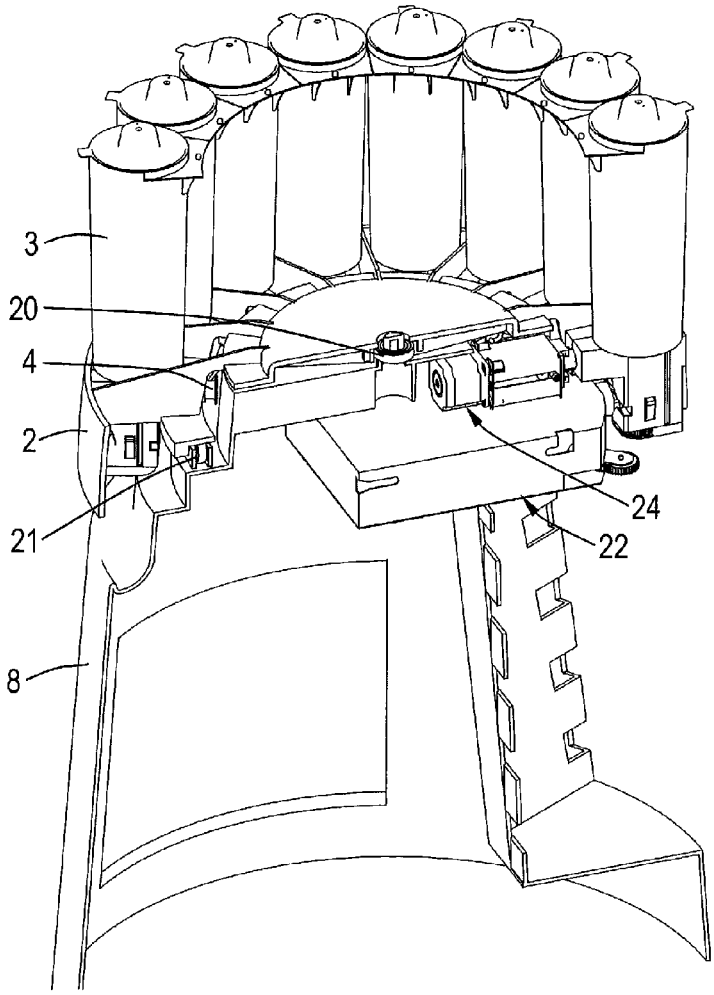
FIGS. 3 and 4 are cross-sections of the apparatus in FIG. 1 showing its entrails including a driving module according to this disclosure.
Figure 4:
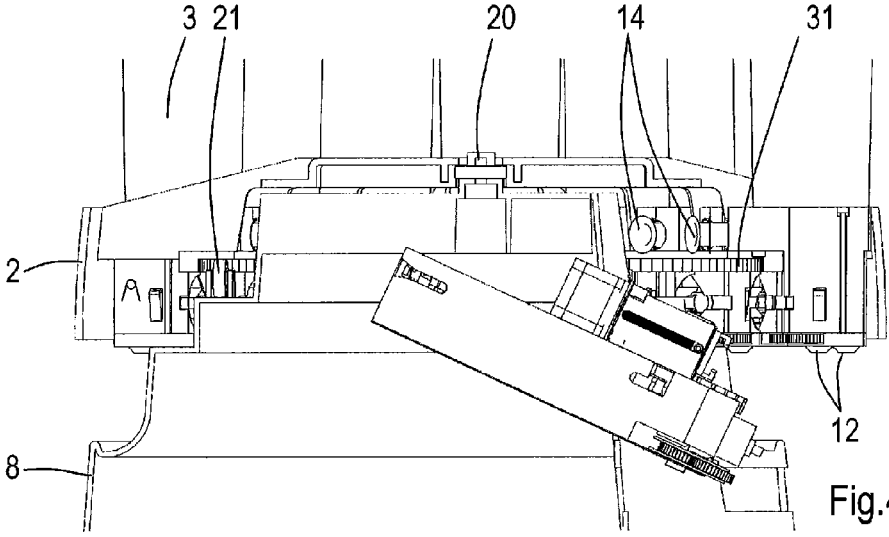

FIGS. 3 and 4 show the entrails of the dispensing apparatus, which include a central bearing 20 and a series of wheels 21 along an edge of the base 8 near its top, the bearing and wheels provide a low friction support for the turntable 2. A swappable module 22 is located beneath the turntable and within the ring of containers and pumps.

Figure 5:
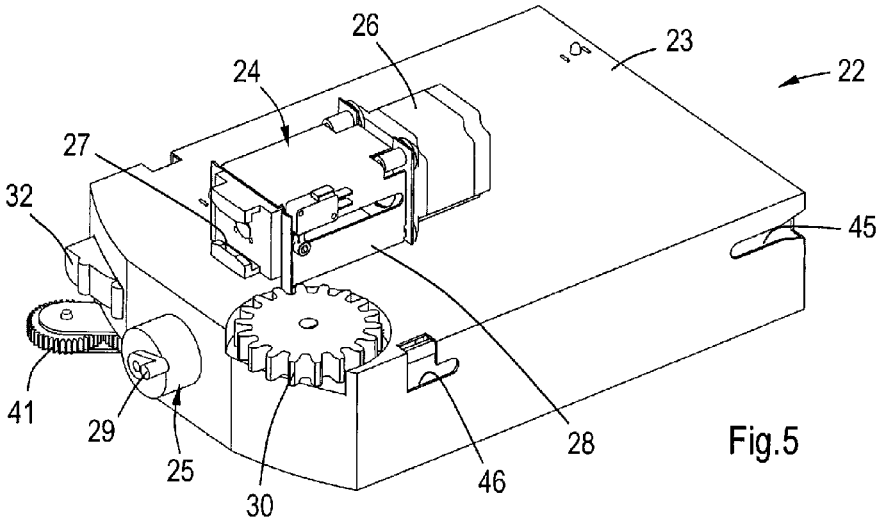
FIG. 5 is a perspective view of the driving module shown in FIGS. 3 and 4.

In this example, the module 22, shown in more detail in FIG. 5, comprises a housing 23 accommodating or carrying actuators 24, 25 for operating the pump 4 and valve 5 of the container 5 at the dispensing position. It further comprises motors and gears for driving the turntable and the stirring elements within the containers, as well as a sensor for establishing the position of the containers relative to the module and connectors (not shown) for connecting the module to an external power source and to the computer 9.

In this example, the actuator 24 for operating the pistons of the pumps 4 is located on top of the module 22 and comprises an electric motor 26, a lead screw (hidden from view) formed on or rigidly connected to the shaft of the electric motor 26 and extending radially with respect to the axis of rotation of the turntable 2. The actuator 24 further comprises a gripper 27 mounted on the lead screw by means of a nut or internal thread, and a guide 28 to prevent the gripper from rotating with the lead screw. The gripper 27 is shaped like a claw, which allows unobstructed rotation of the turntable and the pumps, but engages, when it is moved radially by rotating the lead screw, the flange 14 and hence the piston of the pump 4 in front of it, i.e. the pump 4 at the dispensing position.

The actuator 25 for operating the valves 5 is located in the front of the module 22 directly below the actuator 24 for the pistons and comprises an electric motor (inside the module) and, mounted on the shaft of the electric motor, an eccentric pin 29. Each of the rotary knobs 15 on the valves 5 comprises a slot or ridge extending perpendicular to and through the axis of the rotation of the rotary knob. When a valve is at the dispensing position, the axis of the rotation of the rotary knob is aligned with the axis of rotation of the motor of the actuator 25 enabling the eccentric pin to exert an eccentric force on the slot or ridge and thus rotate the knob to the desired position.

The drive mechanism for rotating the turntable comprises an electric motor (inside the module) and a gear 30. The gear 30 extends in a horizontal plane and is located, in this example, on top of the module 22. As a matter of course, the gear 30 could also be located on the bottom side of the module or protrude trough an opening in the housing of the module at a desired height. The gear intermeshes with an internal gear 31 provided in the turntable 2 (FIG. 4).

As is best shown in FIG. 5, the module 22 further comprises a micro switch 32 or, alternatively, a proximity sensor to cooperate with markers, e.g. protrusions or indeed notches or openings, in the turntable 2 or on the pumps. One of the markers differs, e.g. in length, seen along the circumference of the turntable 2, from the other markers and serves as a reference to establish the position of the turntable relative to the module 22 and thus relative to the dispensing position.

Figure 6:
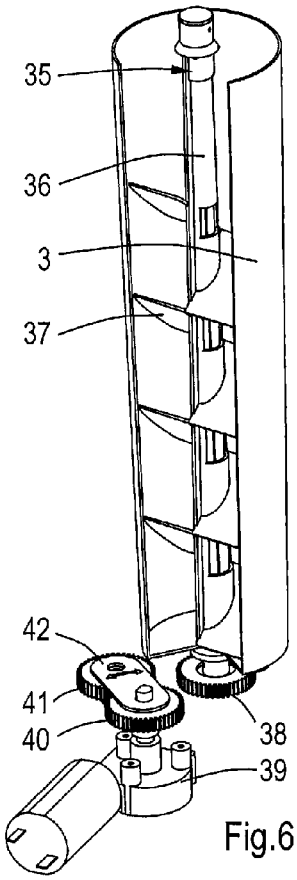
FIG. 6 is a perspective view of a drive mechanism for rotating stirring elements.

As shown in FIG. 6, each of the containers 3 comprises a stirring element 35 having a shaft 36 rotatably mounted in the bottom wall of the respective container. The section of the element that is inside the container comprises e.g. blades 37 or rods shaped to encompass a substantial part of the volume of the respective container. The end of the stirring element extending from the container is provided with a gear 38 to be engaged by a drive mechanism. In this example, the drive mechanism comprises an electric motor 39 and a first gear 40 mounted on the shaft of the motor. A second gear 41 intermeshes with the first gear 40 and is fitted to the first gear 40 by mean of two arms 42. The first and second gears 40, 41 extend in the same plane as the gear 38 on the stirring elements 35.

Figure 7A:
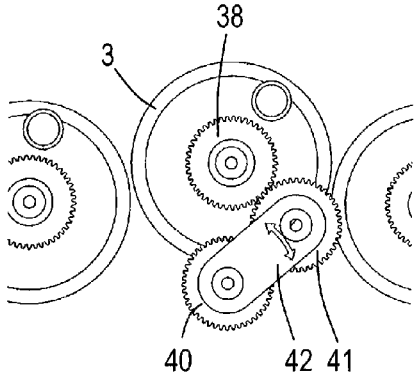
FIGS. 7A and 7B show, seen from below, the drive mechanism of FIG. 6 in engaged (7A) and disengaged (7B) positions.
Figure 7B:
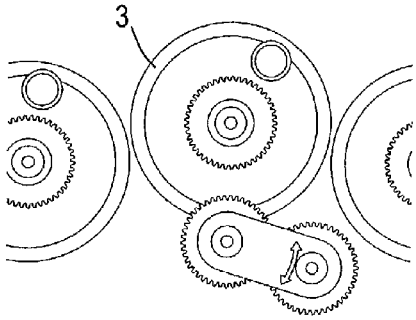

As illustrated in FIGS. 7A and 7B, if the first gear 40 is rotated counterclockwise, the second gear moves 41 towards and engages the gear 38 on the stirring element 35 of the container 3 at the dispensing position. Once engaged, the rotation of the first gear is transmitted, via the second gear, to the gear on the stirring element, resulting in the stirring of the contents of the container. Further, the first gear will continuously urge the second gear into engagement with the gear on the stirring element and/or, as long as the second gear is driven, it will pull itself into engagement with the gear of the stirring element. In this example (FIG. 7A), the arm and a line, connecting the axis of rotation of the gear on the stirring element and the axis of rotation of the second gear, are at an angle of slightly less than 90°.

If the direction of rotation of the motor is reversed, in these Figures to clockwise, the second gear will immediately disengage the gear on the stirring element and the stirring will cease.

The wall of the housing 23 of the module 22 comprises longitudinal slots 45 at or near the rear end and hooked slots 46 at or near the front end, cooperating with corresponding protrusions (not shown) on the inner wall of a bay inside the dispensing apparatus.

As shown in FIG. 4, the module can be installed by first connecting a power supply, e.g. by means of an integrated chassis connector, to the module and then establishing data communication, e.g. wireless or using an USB cable (connected to the computer), and sliding the longitudinal slots over the corresponding protrusions, tilting the module upwards and, once in place, pulling it outwards. Resilient elements can be provided to maintain the outward position.

During operation, the turntable is rotated by means of the drive mechanism about its central axis until it is established with the micro switch and the motor driving the turntable that the required container has reached the dispensing position. Subsequently, the actuators for the valve and the pump and the drive mechanism for the stirrer are activated as described above to dispense a fluid.

As a matter of course, this disclosure is not restricted to the above-disclosed embodiments, which may be varied in different manners within the spirit and scope of this disclosure. For example, the apparatus according to this disclosure can be configured as a linear dispensing apparatus i.e. with the containers aligned is a row. Also, instead of stirring during dispensing, stirring can be postponed to periods when no dispensing takes place, which enables more systematic stirring.

What is claimed is:

1. An apparatus for dispensing a plurality of fluids, comprising:

a turntable support, a plurality of containers for holding a fluid and mounted on the support, pumps and valves connected to respective containers, at least one common actuator for sequentially operating the pumps and valves to dispense fluid and a drive mechanism for moving the support, the at least one common actuator for sequentially operating the pumps and valves and the drive mechanism for relative motion of the support are integrated in a module, the module is releasably mounted to the apparatus.

2. The apparatus according to claim 1, wherein the module is positioned beneath the support and/or behind the pumps.

3. The apparatus according to claim 1, wherein the pumps are piston-pumps and extend radially and horizontally.

4. The apparatus according to claim 1, wherein the module further includes sensors, motors, and a controller for operating the pumps and valves to dispense fluid and for said relative motion.

5. The apparatus according to claim 1, wherein replacing the module with an identical module merely requires disconnecting power and data communication and mechanically disengaging the module and subsequently mechanically engaging and connecting power and data communication of the replacement module.

6. The apparatus according to claim 1, wherein the module comprises a battery and/or an electrical connector for connecting the module to an external power source and/or a connector or receiver for connecting the module to an external controller.

7. The apparatus according to claim 6, wherein the module comprises a rechargeable battery and a controller for operating the actuators to dispense one or more fluids, wherein the apparatus further comprises an external controller and database for preparing and transmitting instructions to the controller in the module, and wherein at least one of the controllers is arranged to assess the power required to carry out the instruction(s) and assess the power available in the battery.

8. The apparatus according to claim 7, wherein dispensing of fluid is prevented if the power available in the battery is lower than the power required to carry out the instruction(s).

9. The apparatus according to claim 7, wherein the apparatus is arranged to generate a signal if the power available in the battery is lower than the power required to carry out the instruction(s).

10. The apparatus according to claim 7, wherein the external controller is arranged to combine the instructions for dispensing two or more fluids into a set and transmit the set to the internal controller.

11. The apparatus according to claim 1, comprising stirring elements mounted rotatably inside the containers and partly extending from the containers and a drive mechanism for rotating the stirring elements, the drive mechanism is integrated in the module.

12. The apparatus according to claim 11, wherein parts of the stirring elements extending from the containers include gears and the drive mechanism comprises a motor, an arm, and a driving gear mounted on the arm such that the driving gear is movable in and out of engagement with the gear of the stirring element of the container disposed at the dispensing position.

13. The apparatus according to claim 12, wherein the drive mechanism comprises a further gear mounted on a drive shaft of the motor and coupled to the driving gear of the drive mechanism.

14. The apparatus according to claim 13, wherein, during engagement, the arm and a line connecting the axis of rotation of the gear of the stirring element of the container disposed at the dispensing position and the axis of rotation of the driving gear are at an angle ranging from 80° to 120°.

15. The apparatus according to claim 1, comprising a hollow base for carrying the support, and wherein at least the containers, pumps, and valves are stored inside the base.

* * * * *